US005417915A

United States Patent [19]

Chau et al.

[11] Patent Number: 5,417,915

[45] Date of Patent: May 23, 1995

[54] PROCESS FOR POST-SPIN FINISHING OF POLYBENZOXAZOLE FIBERS

[75] Inventors: Chieh-Chun Chau; Jang-hi Im, both of Midland, Mich.

[73] Assignee: The Dow Chemical Company, Midland, Mich.

[21] Appl. No.: 162,724

[22] Filed: Dec. 3, 1993

[51] Int. Cl.[6] ..... D01F 6/26

[52] U.S. Cl. ..... 264/344; 264/345

[58] Field of Search ..... 264/344, 345, 346

[56] References Cited

U.S. PATENT DOCUMENTS

| | | | |
|---|---|---|---|
| 4,487,735 | 12/1984 | Chenevey et al. | 264/85 |
| 4,533,693 | 8/1985 | Wolfe et al. | 524/417 |
| 4,581,437 | 4/1986 | Mammone | 528/183 |
| 4,772,678 | 9/1988 | Sybert et al. | 528/179 |
| 4,876,077 | 10/1989 | Murakami | 423/448 |
| 4,915,984 | 4/1990 | Murakami | 427/113 |
| 4,977,223 | 12/1990 | Arnold et al. | 525/432 |
| 4,985,193 | 1/1991 | Allen | 264/184 |

OTHER PUBLICATIONS

Chemical Abstract 111:196226f (p. 59) (1989).

W. W. Adams et al., AFWAL-TR-86-4011, *Processing, Properties, Structure, and Morphology of PBO and ABPBO Polymer Fibers*, Aug., 1986.

English Translation of Japan 2-84,509 (published Mar. 26, 1990).

*Primary Examiner*—Leo B. Tentoni

[57] ABSTRACT

Improved polybenzoxazole fibers are made by a process for drying a wet, coagulated polybenzoxazole (PBO) fiber including the steps of:

(a) drying the fiber at a temperature of no more than 300° C. under a tension of at least about 1 gram per denier (gpd) until it retains no more than about 120 weight percent residual moisture content;

(b) further drying the fiber at a temperature of no more than 300° C., either with or without tension, until it contains no more than about 20 percent residual moisture content; and (c) heat-treating the fiber at a temperature of at least about 300° C. under tension.

14 Claims, No Drawings

PROCESS FOR POST-SPIN FINISHING OF POLYBENZOXAZOLE FIBERS

BACKGROUND OF THE INVENTION

This invention relates to the art of making heat-treated polybenzoxazole fibers.

It is known to spin and heat-treat fibers that contain polybenzazole polymer. See, e.g., Wolfe, U.S. Pat. No. 4,533,693 (Aug. 5, 1985) at col. 166–174; Takeda, Japanese Kokai 2(1990)-84511 (published Mar. 26, 1990): and Ledbetter et al., "An Integrated Laboratory Process for Preparing Rigid Rod Fibers from the Monomers," *The Materials Science and Engineering of Rigid Rod Polymers* at 253, 259–61 (Materials Research Society 1989), which are incorporated herein by reference. Ordinarily, a dope is formed containing the polymer and a solvent acid. The dope is forced through a spinnerette and drawn across an air gap. It is contacted with a coagulating liquid, usually water, to coagulate the polymer and form a fiber. The fiber is washed to remove residual acid. The resulting fiber is heat-treated to improve its modulus.

Within those broad process steps there is still significant room for improvement. The most desirable process conditions may vary from fiber to fiber. What is needed is a process specifically adapted for making the best polybenzoxazole fibers.

SUMMARY OF THE INVENTION

Polybenzoxazole fibers can be damaged by the processes used to wash and heat-treat them after spinning. Surprisingly, the tensile strength of the damaged fiber can remain relatively high for several weeks after the fiber is manufactured, but the tensile strength decreases with the passage of time. An object of the present invention is to choose drying and heat-treating conditions that form a fiber capable of retaining significant tensile strength over time.

It has previously been reported that a fiber should be dried until it contains no more than about 2 or 3 percent residual moisture before it is heat-treated, in order to avoid damage that can cause tensile strength to decrease with time. See copending application Chau et al., Ser. No. 929,272 (filed Aug. 13, 1993), which is incorporated herein by reference. Surprisingly, we have now learned that the fiber may contain higher levels of residual moisture at the commencement of heat-treatment, if it is dried under tension.

The present invention is a process for drying and heat-treating a wet, coagulated polybenzoxazole (PBO) fiber comprising the steps of:

(a) drying the fiber at a temperature of no more than 300° C. under a tension of at least about 1 gram per denier (gpd) until it retains no more than about 120 percent residual moisture content;

(b) further drying the fiber at a temperature of no more than 300° C., either with or without tension, until it contains no more than about 20 percent residual moisture content; and (c) heat-treating the fiber at a temperature of at least about 300° C. under tension.

For the purposes of this Application, "percent residual moisture content" (RMC) means:

$$\frac{(\text{weight of wet fiber}) - (\text{weight of dry fiber})}{(\text{weight of dry fiber})} \times 100\%$$

wherein (weight of wet fiber) is the weight of the fiber when drying commences and the (weight of dry fiber) is the weight of fiber after drying in a hot air oven at 250° C. for about 2 hours.

Fibers made according to the process of the present invention retain their tensile properties well. The fibers can be used for ordinary purposes of high-strength fibers, such as in ropes, composites and other structural applications.

DETAILED DESCRIPTION OF THE INVENTION

The present invention uses a wet, coagulated fiber that contains polybenzoxazole polymer and water.

Suitable polymers and processes to make suitable dopes containing those polymers are well-known in the art. See, e.g., Wolfe, U.S. Pat. No. 4,533,693 (Aug. 5, 1985), Takeda, Japanese Kokai 2(1990)-84511 (published Mar. 26, 1990); Wolfe, "Rigid-Rod Polymer Synthesis: Development of Mesophase Polymerization in Strong Acid Solutions," *The Materials Science and Engineering of Rigid Rod Polymers* at 83–93 (Materials Research Society 1989) and Gregory et al., U.S. Pat. No. 5,233,014 (Aug. 3, 1993), which are incorporated herein by reference.

The polymer may contain AB-mer units, as represented in Formula 1(a), and/or AA/BB-mer units, as represented in Formula 1(b)

1(a)

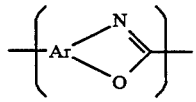

AB

1(b)

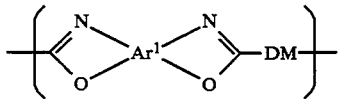

AA/BB wherein:

Each Ar represents an aromatic group selected so that the polymer forms lyotropic liquid crystalline domains in the solvent acid when its concentration is above a critical concentration level. The aromatic group may be heterocyclic, such as a pyridinylene group, but it is preferably carbocyclic. The aromatic group may be a fused or unfused polycyclic system, but is preferably a single six-membered ring. Size is not critical, but the aromatic group preferably contains no more than about 18 carbon atoms, more preferably no more than about 12 carbon atoms and most preferably no more than about 6 carbon atoms. Examples of suitable aromatic groups include phenylene moleties, tolylene moleties and biphenylene moleties. $Ar^1$ in AA/BB-mer units is preferably a 1,2,4,5-tetravalent benzene moiety or an analog thereof. Ar in AB-mer units is preferably a 1,3,4-travalent benzene moiety or an analog thereof.

Each DM is independently a bond or a divalent organic moiety selected so that the polymer forms lyotropic liquid crystalline domains in the solvent acid when its concentration is above a critical concentration level. The divalent organic moiety is preferably an aromatic group (Ar) as previously described. It is most preferably a 1,4-phenylene moiety or an analog thereof.

The nitrogen atom and the oxygen atom in each oxazole ring are bonded to adjacent carbon atoms in the aromatic group, such that a five-membered azole ring fused with the aromatic group is formed.

The oxazole rings in AA/BB-mer units may be in cis- or trans-position with respect to each other, as illustrated in 11 Ency. Poly. Sci. & Eng., supra, at 602, which is incorporated herein by reference.

The polymer preferably consists essentially of one of the repeating units illustrated in Formulae 2(a)–(d).

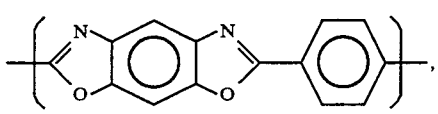
(a)

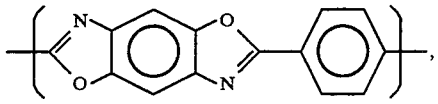
(b)

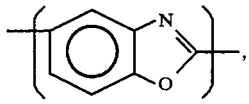
(c)

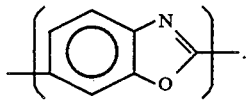
(d)

It more preferably consists essentially of at least one of the repeating units represented in Formulae 2(a) and (b), and most preferably consists essentially of the repeating unit represented by Formula 2(a).

The fibers are preferably spun from a dope that contains PBO polymer dissolved in a solvent acid, such as methanesulfonic acid or polyphosphoric acid. The solvent acid preferably contains polyphosphoric acid. The concentration of polymer is preferably high enough that the dope solution contains liquid crystalline domains. The concentration of polymer is preferably at least about 7 weight percent, more preferably at least about 10 weight percent and most preferably at least about 14 weight percent. The maximum concentration of polymer in the dope is governed primarily by practical considerations, such as the viscosity of the dope. Dopes ordinarily contain no more than 30 weight percent polymer and typically contain no more than 20 weight percent polymer. When the solvent acid is polyphosphoric acid, it preferably contains at least about 80 weight percent $P_2O_5$ and no more than about 86 weight percent $P_2O_5$.

The dope can be spun to form a fiber according to known processes. Useful spinning processes are known and described in the references previously incorporated by reference. Other useful processes are reported in Chau et al, Ser. No. 985,079 (filed Dec. 3, 1992), which is incorporated herein by reference. Useful spinning processes can also be adapted from the spinning of polybenzothiazole and polybenzimidazole polymer dopes, and are described in numerous references, such as Tan, U.S. Pat. No. 4,263,245 (Apr. 21, 1981); Ide, U.S. Pat. No. 4,332,759 (Jun. 1, 1982); and Chenevey, U.S. Pat. No. 4,606,875 (Aug. 19, 1986), which are incorporated herein by reference.

The dope is forced through a spinnerette and drawn across an air gap. The spinnerette may contain a single hole or multiple holes. The holes may range in diameter from 50 μm to 1000 μm. They are preferably at least about 75 μm and preferably no more than 500 μm. The temperature of the die and dope is preferably at least about 100° C. and more preferably at least about 130° C. It is preferably no more than about 200° C. and more preferably no more than about 180° C. The optimum force pushing the dope through the spinnerette varies depending upon the spinnerette and spinning conditions, and can be ascertained by persons of ordinary skill in the art. The air gap is preferably at least about 1 mm and more preferably at least about 5 mm. The air gap is preferably no more than about 100 cm. The spin-draw ratio of the dope fiber as it is drawn across the air gap is preferably at least about 1 and more preferably at least about 5. The optimum spin draw ratio depends on the spin die and other conditions of spinning, but it is usually less than 1000.

The spun and drawn fiber is coagulated by contacting it with an aqueous coagulant. The coagulant may contain acid or base. Its pH is preferably at least about 1.0 and more preferably at least about 3.0. It is preferably no more than about 12 and more preferably no more than about 9. The coagulant may also contain organic diluents, but it preferably does not. The coagulant may be at any temperature at which it is not frozen (usually between about 0° C. and 100° C.), but is preferably between about 0° C. and about 20° C.

After the fiber has been coagulated, it is washed to remove residual acid. The washing uses an aqueous washing fluid. The washing fluid may be acidic or basic, but is conveniently about neutral. The pH of the washing fluid is preferably at least about 3, and more preferably at least about 5. The pH of the washing fluid is preferably no more than about 10 and more preferably no more than about 8. The washing fluid may be a liquid or it may be steam. Liquid washing fluids may be at any temperature from about 0° C. to about 100° C. (or more if high pressure is used). The temperature is preferably at least about 5° C. and more preferably at least about 10° C.

Washing may be carried out in a single stage, or in different stages such as a brief on-line washing followed by longer static washing. In a convenient static washing technique, the fiber is taken up onto a perforated spool. Running water is continuously fed into the center of the spool, from which it passes out through the perforations and the fibers. Washing may be in static water, but is preferably in running water.

The washing is preferably continued for no more than 72 hours, but until the residual solvent acid content of the fiber is no more than about 24000 ppm after washing and drying. High levels of residual solvent acid are undesirable in many end uses, but excessive washing may leave the fiber susceptible to loss of tensile strength over time, particularly if the fiber sustains other damage during the manufacturing process.

The residual acid content in the fiber after washing and drying is preferably no more than about 15,000 ppm, more preferably no more than about 6000 ppm and most preferably no more than about 3000 ppm. When the solvent acid was polyphosphoric acid, then the residual phosphorus content is preferably no more than about 5000 ppm, more preferably no more than about 2000 ppm, and most preferably no more than about 1000 ppm. Although it is desirable to minimize the residual solvent acid content, the washed and dried fiber usually contains some measurable concentration of solvent acid. The fiber frequently contains at least about 100 ppm residual acid and most often contains at least about 500 ppm residual acid. The fiber is preferably washed for no more than about 48 hours, more preferably no more than about 24 hours, more highly preferably no more than about 12 hours and most preferably no more than about 3 hours.

It is important to dry the fiber before the fiber is heat-treated. The coagulated and washed fiber usually contains more water than polymer. The fiber sustains significant damage if it is heat-treated before most of that water is removed. Preferably, the fiber is dried immediately or very shortly after washing is complete. Long storage in a wet condition contributes to instability of fiber tensile strength.

The fiber must be dried at a temperature high enough to remove the water in a time and cost effective manner, but low enough to prevent damage to the fiber. The temperature is preferably at least about 20° C., more preferably at least about 50° C., more highly preferably at least about 120° C., and most preferably at least about 150° C. The temperature of drying is preferably no more than about 300° C., more preferably no more than about 250° C., and most preferably no more than about 200° C. As the residual moisture content of the fiber goes down, the temperature at which the fiber may be dried without substantial damage goes up, as described in copending application: Im, U.S. Ser. No. 08/142,526 (filed Nov. 2, 1993), which is incorporated herein by reference.

The fiber is dried under tension for at least part of the drying process. The tension is at least about 1 gpd, preferably more than 1 gpd, more preferably at least about 2 gpd and most preferably at least about 4 gpd. The maximum tension is not a critical factor as long as the fiber does not break, but excessive tension yields diminishing improvements, and may eventually damage the fiber so that it performs worse. The tension is preferably no more than about 20 gpd, more preferably no more than about 10 gpd, and most preferably no more than about 8 gpd.

The fiber is dried in the first stage of drying under tension until it contains no more than about 120 percent RMC, preferably until it contains no more than about 50 percent RMC, more preferably until it contains no more than about 30 percent RMC, and most preferably until it contains no more than about 20 percent RMC. Thereafter, the fiber is further dried in the second stage of drying until it contains no more than about 20 percent RMC, preferably no more than about 16 percent RMC, more preferably no more than about 12 percent RMC, and most preferably no more than about 8 percent RMC. The fiber may contain about 0 percent RMC at the end of the second stage of drying, but it preferably contains at least about 2 percent RMC, and more preferably more than 3 percent RMC. The second stage of drying may optionally be carried out without tension, but it is preferably carried out with tension, and more preferably is a simple continuation of the first stage of drying.

The times necessary to obtain the desired residual moisture vary widely depending upon the fiber and the conditions under which it is dried. Drying under tension is preferably carried out using heated rollers, which are commercially available. Drying may be in a single step or in multiple steps, such as using multiple rollers. Drying is preferably carried out predominantly in the dark and predominantly under atmosphere that is inert with respect to the fiber under drying conditions, such as nitrogen or argon.

The fiber may optionally be stored for a period of time after it is dried and before it is heat-treated. Storage is preferably in the dark, in a dry atmosphere and in an inert atmosphere.

the dried fiber is heat-treated in order to improve its tensile modulus. Heat-treatment and processes to accomplish it are well-known. Preferred heat-treatment techniques are described in Yabuki, U.S. Ser. No. 07/985,067 (filed Dec. 3, 1992) and Tani, U.S. Ser. No. 7/985,068 (filed Dec. 3, 1992), which are incorporated herein by reference. Heat-treatment is preferably carried out at a temperature of at least about 300° C., more preferably at least about 450° C. and most preferably at least about 500° C. The temperature of heat-treatment is preferably no more than about 1000° C., more preferably no more than about 800° C. and most preferably no more than about 700° C. The fiber is heat-treated under tension. The optimal tension varies depending upon the fiber and the process in which it is heat-treated. The tension is usually between about 0.1 g/d and 10 g/d, and preferably between about 2 g/d and 6 g/d. The optimum time of heat-treating varies broadly depending upon the fiber and the process conditions used to heat-treat it. The time is usually at least about 1 sec, and usually no more than about 30 sec. The atmosphere may be any which does not significantly damage the fiber. It is usually air or an inert atmosphere such as nitrogen, carbon dioxide or argon. The modulus of the heat-treated fiber is preferably at least about 10 percent higher than the tensile modulus of the non-heat-treated fiber, more preferably at least about 50 percent higher and most preferably at least about 100 percent higher.

The resulting fibers are strong, have high modulus and retain their tensile properties well. The fiber preferably has initial tensile strength of at least about 600 ksi (1 ksi=1000 psi), more preferably at least about 700 ksi and most preferably at least about 800 ksi, its tensile modulus is preferably at least about 38 msi (1 msi=1,000,000 psi), more preferably at least about 40 msi and most preferably at least about 45 msi.

Property retention can be accurately estimated by irradiating a sample of the fiber in a HERAEUS SUN TEST CPS TM instrument using 765 watts per square meter of xenon irradiation with a quartz filter for a desired period of time from about 100 hours to about 300 hours. The tensile strength of fiber samples is tested before and after irradiation by ordinary means, such as using an INSTRON TM tensile testing instrument to measure the force required to break a yarn bundle of fiber.

After 100 hours of irradiation under the previously described conditions the fiber preferably retains at least about 75 percent of its initial tensile strength, more preferably at least about 80 percent, more highly preferably at least about 85 percent and most preferably at least about 90 percent of its original tensile strength. The tensile strength of irradiated fibers is preferably at least about 500 ksi, highly preferably at least about 550 ksi, more preferably at least about 600 ksi and most preferably at least about 650 ksi. The fiber may be used in composites, strong ropes and numerous other applications.

The invention is illustrated by the following examples:

ILLUSTRATIVE EXAMPLES

The following examples are for illustrative purposes only and should not be taken as limiting the scope of either the specification or the claims. Unless stated otherwise, all parts and percentages are by weight.

Example 1

A dope contains 14 weight percent cis-polybenzoxazole polymer having an inherent viscosity of about 30 dL/g dissolved in polyphosphoric acid. The dope is spun through a 340 filament spin-die having an average hole diameter of about 150 μm at a rate of about 70 m/min. The dope fibers are drawn across an air gap of about 6 inches with a spin-draw ratio of about 33. The fibers are coagulated in water. The fibers are washed for 48 hours in running water.

The wet fibers are dried over heated rollers for the residence time shown in Table 1 and at the roller temperature shown in Table I. The rollers apply the tension shown in Table 1, as measured by a CHECKLINE TM tensiometer sold by Electromatic Equipment Co. The residual moisture content of the fibers are measured after drying by: (1) cutting and weighing a sample; (2) drying the sample for 2 hours at 250° C.; and (3) reweighing the sample to determine moisture lost. Certain of the fibers are further collected upon a roll and dried under flowing dry nitrogen for the time and at the temperature shown in Table 1.

The fiber samples have the denier shown in Table 1. They are heat-treated at 600° C. and 4 gpd tension for 8 sec residence time. An initial tensile strength is measured and shown in Table 1.

The fibers are subjected to accelerated photoaging as follows.

Each sample is irradiated in a HERAEUS SUN TEST CPS TM instrument using 765 watts per square meter xenon irradiation with a quartz filter, operated at full intensity for about 100 hours. The tensile properties of the fibers are measured before and after testing.

The properties of the irradiated fibers are set out in Table 1.

TABLE 1

| No | Denier | Stage 1 Drying Temp. (°C.) | Stage 1 Drying Time (sec) | Stage 1 Drying Tension (gpd) | Stage 1 RMC (%) | Stage 2 Drying Temp (°C.) | Stage 2 Drying Time (hr) | Stage 2 RMC (%) | Initial Tensile Str. (ksi) | Irrad. Tensile Str. (ksi) |
|---|---|---|---|---|---|---|---|---|---|---|
| 1 | 493.9 | 150 | 37.3 | 1.3 | 21.08 | — | — | — | 583 | 524 |
| 2 | 492.3 | 150 | 44.8 | 1.3 | 20.17 | — | — | — | 601 | 540 |
| 3 | 495.9 | 150 | 59.7 | 1.3 | 14.56 | — | — | — | 608 | 541 |
| 4 | 494.6 | 150 | 71.0 | 1.3 | 12.75 | — | — | — | 573 | 547 |
| 5 | 490.0 | 25 | 37.3 | 1.3 | 92.44 | 25 | 48 | 4.12 | 669 | 626 |
| 6 | 491.6 | 25 | 7.5 | 1.3 | 126.7 | 25 | 48 | 2.12 | 659 | 582 |
| 7 | 494.1 | 25 | 18.7 | 1.3 | 113.9 | 25 | 48 | 3.9 | 671 | 669 |
| 8 | 494.3 | 150 | 7.5 | 1.3 | 31.16 | 25 | 5 | 8.99 | 651 | 505 |
| 9 | 497.9 | 150 | 14.9 | 1.3 | 27.10 | 25 | 5 | 9.69 | 617 | 515 |
| 10 | 493.4 | 150 | 22.4 | 1.3 | 24.53 | 25 | 5 | 10.57 | 652 | 582 |
| 11 | 491.6 | 150 | 29.8 | 1.3 | 22.46 | 25 | 5 | 11.80 | 629 | 541 |
| 12 | 493.9 | 150 | 37.3 | 1.3 | 21.08 | 25 | 5 | 11.98 | 641 | 522 |
| 13 | 492.3 | 150 | 44.8 | 1.3 | 20.17 | 25 | 5 | 11.72 | 606 | 506 |
| 14 | 495.9 | 150 | 59.7 | 1.3 | 14.46 | 25 | 5 | 11.72 | 593 | 518 |
| 15 | 494.6 | 150 | 71.0 | 1.3 | 12.75 | 25 | 5 | 11.39 | 609 | 518 |
| 16 | 491.0 | 125 | 7.5 | 1.3 | * | 25 | * | 3.16 | 652 | 608 |
| 17 | 491.9 | 125 | 14.9 | 1.3 | * | 25 | * | 3.21 | 676 | 592 |
| 18 | 492.3 | 125 | 22.4 | 1.3 | * | 25 | * | 3.32 | 696 | 575 |
| 19 | 489.4 | 125 | 29.8 | 1.3 | * | 25 | * | 3.33 | 695 | 572 |
| 20 | 489.2 | 125 | 37.3 | 1.3 | * | 25 | * | 3.55 | 683 | 586 |
| 21 | 491.0 | 125 | 44.8 | 1.3 | * | 25 | * | 3.83 | 685 | 577 |
| 22 | 495.0 | 125 | 44.8 | 5.1 | * | 25 | * | 5.64 | 655 | 615 |
| 23 | 486.9 | 155 | 29.8 | 2.1 | 14.38 | — | — | — | 633 | 473 |
| 24 | 489.2 | 155 | 29.8 | 8.7 | 16.81 | — | — | — | 578 | 496 |
| 25 | 488.3 | 155 | 29.8 | 6.6 | 17.31 | — | — | — | 603 | 505 |
| 26 | 487.1 | 155 | 29.8 | 4.6 | 16.27 | — | — | — | 612 | 516 |

*means not measured or not recorded
— means this operation not performed

What is claimed is:

1. A process for drying a wet, coagulated polybenzoxazole (PBO) fiber comprising the steps of:
   (a) drying the fiber at a temperature of no more than 300° C. under a tension of at least about 1 gram per denier (gpd) until it retains no more than about 120 weight percent residual moisture content;
   (b) further drying the fiber at a temperature of no more than 300° C., either with or without tension, until it contains no more than about 20 percent residual moisture content; and
   (c) heat-treating the fiber at a temperature of at least about 300° C. under tension.

2. The process of claim 1 wherein the temperature of drying in steps (a) and (b) is at least about 120° C.

3. The process of claim 1 wherein the residual moisture content at the end of Step (a) is no more than about 50 percent.

4. The process of claim 1 wherein the residual moisture content at the end of Step (a) is no more than about 20 percent.

5. The process of claim 1 wherein the residual moisture content at the end of Step (b) is at least about 2 percent.

6. The process of claim 5 wherein the residual moisture content at the end of Step (b) is no more than about 16 percent.

7. The process of claim 1 wherein the tension in Step (a) is at least about 2 gpd.

8. The process of claim 1 wherein the tension in Step (a) is no more than about 8 gpd.

9. The process of claim 1 wherein the temperature of Step (c) is about 500° C. to 800° C.

10. The process of claim 1 wherein the polybenzoxazole polymer contains one or more of the repeating units:

(a)

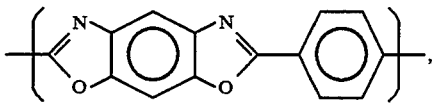

(b)

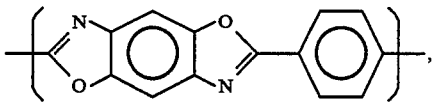

(c)

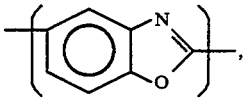

(d)

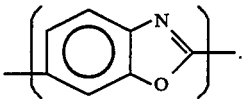

11. The process of claim 8 wherein the polybenzoxazole polymer consists essentially of one or more of the repeating units:

(a)

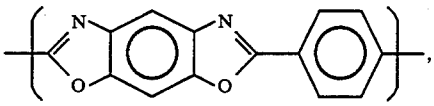

(b)

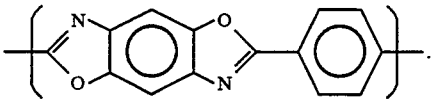

12. The process of claim 8 wherein the polybenzoxazole polymer consists essentially of one or more of the repeating units:

(c)

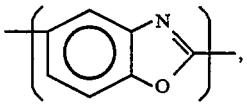

(d)

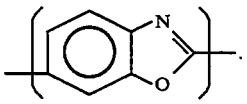

13. The process of claim 1 wherein the fiber has a tensile strength of at least about 550 ksi after 100 hours of irradiation using 765 watts per square meter xenon irradiation with a quartz filter.

14. The process of claim 1 wherein the fiber has a tensile strength of at least about 600 ksi after 100 hours of irradiation using 765 watts per square meter xenon irradiation with a quartz filter.

* * * * *